US006244658B1

(12) United States Patent
Parent et al.

(10) Patent No.: US 6,244,658 B1
(45) Date of Patent: Jun. 12, 2001

(54) ROCKING CHAIR WITH AUTOMATIC UNIDIRECTIONAL LOCKING DEVICE

(75) Inventors: Réal Parent; Maxime Cartier, both of Drummondville (CA)

(73) Assignee: Veranda Jardin R.P. Inc., Drummondville (CA)

( * ) Notice: Subject to any disclaimer, the term of this patent is extended or adjusted under 35 U.S.C. 154(b) by 0 days.

(21) Appl. No.: 09/644,851

(22) Filed: Aug. 24, 2000

Related U.S. Application Data

(63) Continuation-in-part of application No. 09/285,445, filed on Apr. 2, 1999, now Pat. No. 6,120,094.

(51) Int. Cl.[7] ..... A47C 3/03

(52) U.S. Cl. ..... 297/270.1; 297/270.1; 297/270.2; 297/270.3; 297/281

(58) Field of Search ..... 297/270.1, 270.2, 297/270.3, 270.4, 281, 282

(56) References Cited

U.S. PATENT DOCUMENTS

| | | | | |
|---|---|---|---|---|
| 979,236 | * | 12/1910 | Williams | 297/282 |
| 1,965,785 | * | 7/1934 | Vallone | 297/281 |
| 3,826,532 | | 7/1974 | Caldemeyer . | |
| 5,186,549 | * | 2/1993 | Walters et al. | 297/281 |
| 6,092,870 | * | 7/2000 | Desnoyers et al. | 297/281 |

FOREIGN PATENT DOCUMENTS 486858 9/1962 (CA) .

812041 5/1969 (CA) .

* cited by examiner

*Primary Examiner*—Anthony D. Barfield
(74) *Attorney, Agent, or Firm*—François Martineau

(57) ABSTRACT

The rocking chair includes a ground-resting base, a seat support frame and rocking arms rockably mounting the seat support frame to the base. A seat, defining a front end portion and a rear end portion, is pivotally mounted on the support frame at its front end portion allowing limited up and down movement of its seat rear end portion between an upper position and a lower limit position. A stop is carried by said seat support frame and engages the seat rear end portion in its lower limit position. A spring continuously forces the seat towards said upper position, and the weight of a person seated on the seat rear end portion will effectively lower the seat rear end portion to its lower limit position against the bias of the spring. The rocking chair also includes a unidirectional two part ratchet locking device having a ratchet wheel carried by one of the rocking arms, and a pawl pivotally carried by the seat support frame. A rigid link rod pivotally links the seat rear end portion to the pawl, with the pawl engaging the ratchet wheel when the seat is in its upper position and clearing the ratchet wheel when the seat is in its lower limit position. The seat and the seat support frame are automatically locked against rocking in a rearward direction while being allowed to rock in a forward direction when the pawl engages the ratchet wheel, while the seat and seat support frame are allowed to rock in both the forward and rearward directions when the pawl clears the ratchet wheel.

16 Claims, 7 Drawing Sheets

ROCKING CHAIR WITH AUTOMATIC UNIDIRECTIONAL LOCKING DEVICE

CROSS-REFERENCE DATA

This is a Continuation-in-Part of patent application No. 09/285,445 filed Apr. 2, 1999, now U.S. Pat. No. 6,120,094 by the present applicant.

FIELD OF THE INVENTION

The present invention relates to a rocking chair, and more particularly to a rocking chair with an automatic locking device to prevent rocking when a person rises from the chair.

BACKGROUND OF THE INVENTION

Various types of known rocking chairs are equipped with a locking device to releasably lock the chair against rocking when so desired by the user.

Examples of such rocking chairs are described in U.S. Pat. No. 3,826,532 dated Jul. 30, 1974, entitled Rocking recliner with rocker lock and anti-overturn shock absorber, inventor Daniel F. CALDEMEYER, and in Canadian Patent 486,858 dated Sep. 30, 1962, entitled Locking device for rocking chair, inventor Adelard J. BELISLE.

In the U.S. Caldermeyer Patent, the rocking chair is prevented from rocking by operating a hand lever 44 which causes a cam 43 carried by a chair runner 17 to engage the serrations of a rod 47 (see FIGS. 1 and 2).

In the Canadian Belisle Patent, operation of a manual lever 32 causes gripping of the plate 20 which locks the seat against rocking.

In both these patents, the two parts of the locking device are carried by the base member and by the seat respectively. Therefore, it is impossible to automatically lock the seat against rocking when a person leaves the chair and to permit rocking when the person becomes seated on the chair.

OBJECTS OF THE PRESENT INVENTION

The general object of the invention is to provide a rocking chair with an automatic locking device which automatically locks the chair against rocking when a person leaves the chair and allows the chair to be rocked when a person sits on the chair.

An important object of the present invention is to provide a rocking chair with an automatic locking device as described, which is of simple and inexpensive construction.

Another object of the present invention is to provide a rocking chair with an automatic locking device controlled by a manual lever having two positions, an ON position causing the above-noted automatic unlocking of the chair when a person sits on the same and locking of the chair when a person leaves the chair, and an OFF position allowing the chair to be rocked whether a person is seated or not on the chair.

It is a further object of the present invention to provide a rocking chair with an automatic locking device which will become locked as soon as a person starts to rise from the chair, and which will remain in a locked position as long as a person is not sitting in the rear portion of the chair.

It is yet another object of the present invention to provide a rocking chair with an automatic locking device which will be as silent as possible.

It is an important object of the present invention to provide a rocking chair having a seat portion rockable in a back and forth movement, the rocking chair having an unidirectional locking device which can be set in either one of an operative condition, in which the seat portion is allowed to rock in a forward direction while being prevented to rock in a rearward direction, and an inoperative condition, in which the seat portion is allowed to rock in both the forward and the rearward direction.

SUMMARY OF THE INVENTION

The present invention relates to a rocking chair comprising a ground-resting base member, a seat support frame, a rocking device rockably mounting said seat support frame to said base member, a seat defining a front end portion and a rear end portion and pivotally mounted on said support frame at said front end portion allowing limited up and down movement of said seat rear end portion between an upper position and a lower limit position, a stop carried by said seat support frame and engaging said seat rear end portion in its lower limit position, a biasing device continuously biasing said seat towards said upper position, the weight of a person seated on said seat rear end portion lowering said seat rear end portion to its lower limit position against the bias of said biasing device, and a unidirectional two part ratchet locking device having a first and a second part respectively carried by a corresponding one of:

a) a selected one of said base and said rocking device; and b) said seat support frame; said first and second parts of said unidirectional two part ratchet locking device being mutually engageable when said seat is in said upper position and clearing each other when said seat is in said lower limit position, wherein said seat and said seat support frame are automatically locked against rocking motion in the direction of said seat rear end portion while being allowed to rock in the direction of said seat front end portion when said first and second parts of said unidirectional two part ratchet locking device are mutually engaged, and wherein said seat and said seat support frame are allowed to rock in both the directions of said seat front and rear end portions when said first and second parts of said unidirectional two part ratchet locking device clear each other.

Preferably, said seat support frame forms arm rests disposed above said seat.

Preferably, said rocking chair further includes a back rest attached to said seat support frame in an upstanding position relative to said seat.

Preferably, said rocking device includes front and rear rocking arms defining opposite upper and lower end portions, said rocking arms depending from said base member and being pivotally mounted thereon at said upper end portions thereof, and a lower portion of said seat support frame being pivotally connected to said lower end portions of said rocking arms.

Preferably, said first part of said two part ratchet locking device is a ratchet wheel fixedly attached on the lower end portion of one of said rocking arms for concurrent pivotal displacement therewith, and said second part of said two part ratchet locking device is a pawl member pivotally attached to said seat support frame, said ratchet locking device further comprising a rigid link member pivotally attached to said seat rear end portion and to said pawl member, said link member pivoting said second pawl member in a first locked condition, when said seat is in said upper position, in which said pawl member and said ratchet wheel are mutually engaged to prevent rocking of said seat and said seat support frame in the direction of said seat rear end portion, while allowing rocking motion of said seat and said seat support frame in the direction of said seat front end portion, and a second unlocked condition, when said seat in said lower limit position, in which said pawl member clears said ratchet wheel to allow rocking motion of said seat and said seat support frame in both the directions of said seat front and rear end portions.

Preferably, said ratchet locking device further comprises a biasing device attached to said pawl member and to said seat support frame, said biasing device continuously biasing said pawl member towards said locked condition.

Preferably, said biasing device is a spring.

The invention also relates to a rocking chair comprising a ground-resting base member, a seat support frame, a rocking device rockably mounting said seat support frame to said base member, a seat defining a front end portion and a rear end portion and pivotally mounted on said support frame at said front end portion allowing limited up and down movement of said seat rear end portion between an upper position and a lower limit position, a stop carried by said seat support frame and engaging said seat rear end portion in its lower limit position, a biasing device continuously biasing said seat towards said upper position, the weight of a person seated on said seat rear end portion lowering said seat rear end portion to its lower limit position against the bias of said biasing device, and a unidirectional locking device including:

a first part and a second part each respectively mounted to a corresponding one of:

a) a selected one of said base member and said rocking device; and b) said seat support frame;

a ratchet joint member provided on said first and second parts; and a link member linking said seat rear end portion to said locking device second part for concurrent displacement of said second part between a locked position and an unlocked position responsively to corresponding displacement of said seat between said upper position and said lower limit position respectively, with said ratchet joint member being inoperative in said second part unlocked position and being operative in said second part locked position, wherein said seat and said seat support frame are automatically locked against rocking motion in the direction of said seat rear end portion while being allowed to rock in the direction of said seat front end portion when said ratchet joint member is operative, and wherein said seat and said seat support frame are allowed to rock in both the directions of said seat front and rear end portions when said ratchet joint member is inoperative.

BRIEF DESCRIPTION OF THE DRAWINGS

In the annexed drawings, wherein like reference characters indicate like elements throughout.

DETAILED DESCRIPTION OF THE PREFERRED EMBODIMENTS

Figure 1:
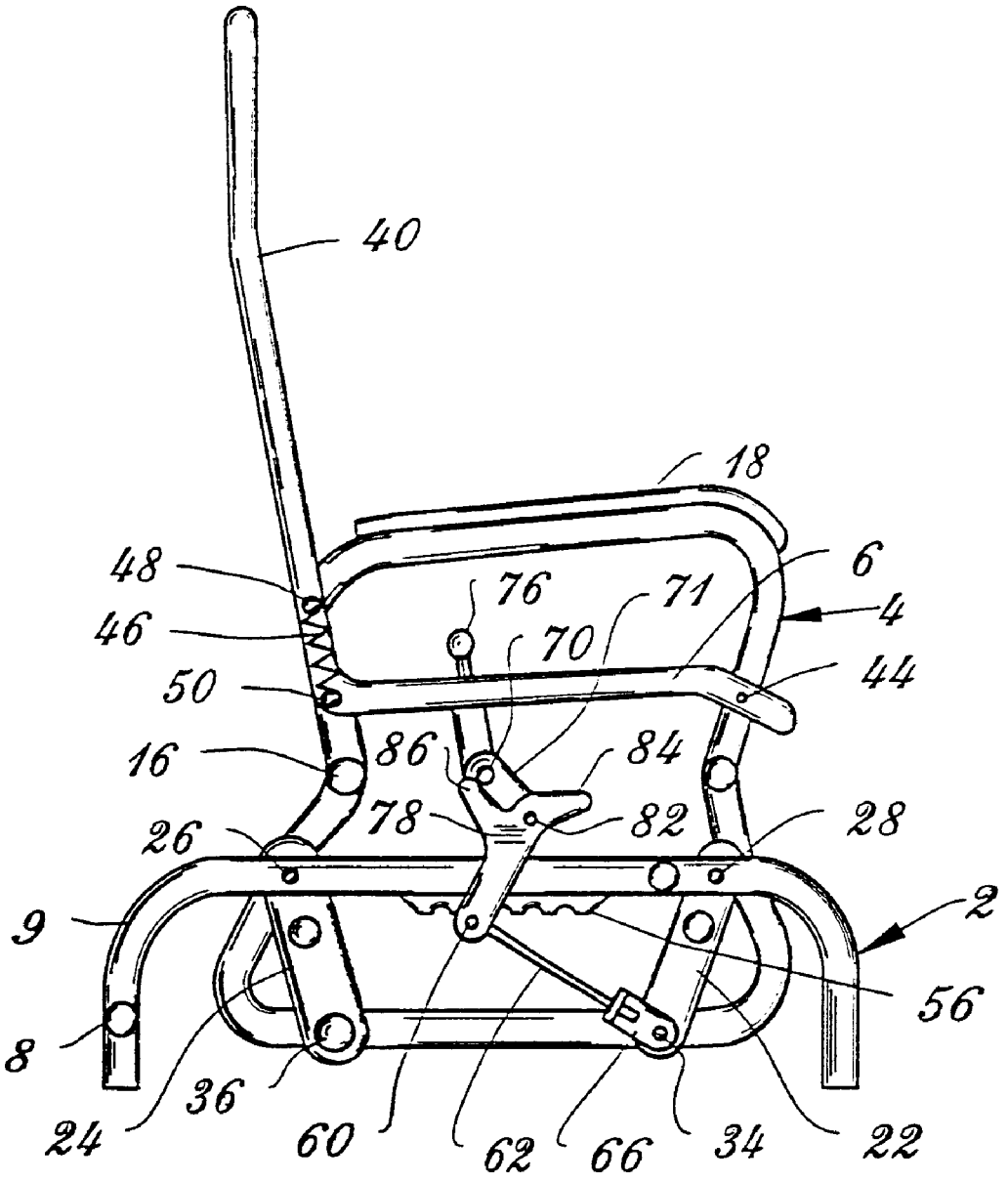
FIGS. 1, 2 and 3 are vertical sections of a first embodiment of the rocking chair of the invention in various positions of its component parts.

Reference will now be made to the first embodiment of the rocking chair, shown in FIGS. 1 to 4.

The chair of the invention comprises a base 2, a seat support frame 4 and a seat 6 carried by the seat support frame 4 which is in turn rockably supported by the base 2.

The base 2 includes a pair of parallel inverted U-shape tubular members joined by cross braces 8 and forming four legs 9 and two upper bight members 10.

The seat support frame 4 is formed of a pair of spaced parallel quadrangular tubular members 14 rigidly interconnected by tubular cross braces 16. The top of each tubular members 14 carries an arm rest 18. Base 2 and seat 6 fit within seat support frame 4.

The chair is provided with a rocking mechanism which consists of a pair of front arms 22 and a pair of rear arms 24 which depend by means of top pivots 26 and 28 respectively from the bight members 10 of the base 2. Front and rear arms 22, 24 are respectively interconnected by a cross brace 30 in the form of a tube inserted into a webbed sleeve 32 secured to the inside of the arms.

The lower ends of the front and rear arms 22, 24 are pivotally connected to the lower portion of the seat support frame 4 by means of front and back pivots 34 and 36 respectively.

A back rest 40 is secured to seat 6 by means of braces 42, which can be made adjustable so as to adjust the inclination of the back rest 40 with respect to seat if so desired. The front portion of seat 6 is pivotally connected by pivots 44 to the front of the seat support frame 4, below arm rests 18. The rear portion of seat 6 can pivot upwardly and downwardly about pivots 44 with respect to seat support frame 4. Seat 6 is biased to an upper position under the action of a pair of tension springs 46, located on each side of seat 6, and attached at their upper end to rivets 48 fixed to the back of the quadrangular tubular members 14 and at their lower end to a cross rod 50 joining the back rest 40 to seat 6.

Seat can pivot downwardly against the bias of tension springs 46 to a lower limit position in which it abuts the rear cross brace 16 of the seat support frame 4.

Chair is further provided with a two parts locking device. One part is a toothed bar 56 secured to and exposed under one bight member 10 of base 2. The other part of the locking device includes a U-shape locking rod 58, the bight 60 of which meshes with the toothed bar 56 and the legs 62 of which have threaded outer ends 64, each of which engages a hole in an L-shape strip 66 and is adjustably secured thereto by means of nuts 67. These L-shape strips 66 are pivoted to the lower ends of front rocking arms 22 by means of the pivots 34.

A tension spring 68 is attached at its lower end to the center of bight 60 of U-shape locking rod 58 and at its top end to a cross rod 70 which is rotatably mounted within the lower ends of dependent arms 72 fixed to each side of seat 6. A manual lever 76 is secured to each end of cross rod 70 and is accessible to the chair user. Each one of a pair of Y-shape arms 78 has its lower end rotatably carried at 80 by the bight 60 of U-shape locking rod 58 and is pivoted at its upper portion by a pivot 82 to the lower end of short arms 71 which are secured to cross rod 70. Each Y-shape arm 78 has a front stop 84 and a back stop 86 limiting the pivotal movement of the toggle lever 71, 78; more specifically, in the ON, upward position of the manual lever 76 (see FIGS. 1 and 2), the back stop 86 engages cross rod 70 while in the OFF, forward position of the lever (see FIG. 3), the front stop 84 engages cross rod 70. Tension spring 68 biases toggle lever 71, 78 to either one of its positions which are defined by the ON and OFF positions of lever 76. Toggle lever 71, 78 forms a length adjustable link joining locking rod 58 to seat 6. The ON and OFF positions of lever 76 correspond to the shorter and longer limit position of said link respectively.

Figure 2:
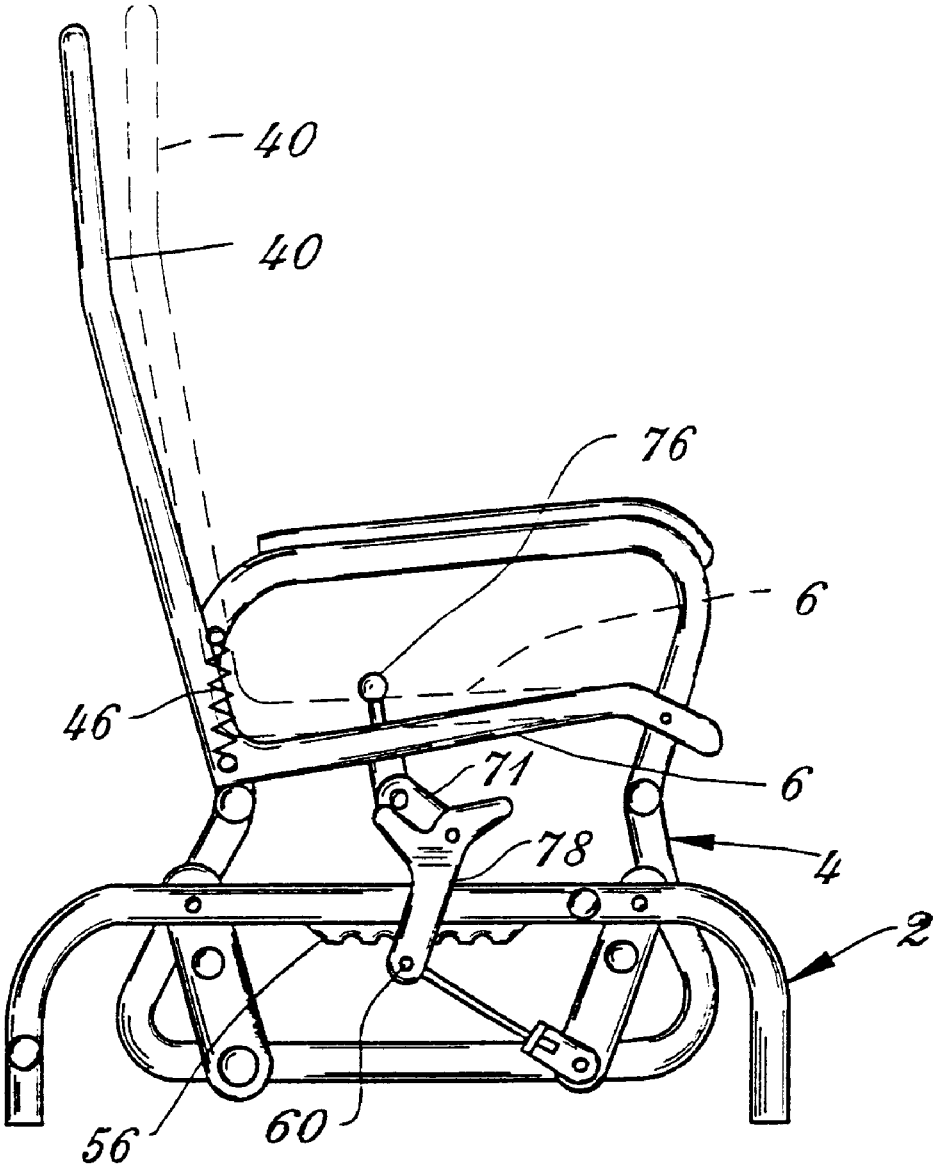

The rocking chair of the invention operates as follows:

Referring to FIGS. 1 and 2, when the manual lever 76 is in ON position; if no person sits on the seat 6, the tension springs 46 bias seat 6 upwardly to an upper limit position in which the bight 60 of the U-shape rod 58 meshes with toothed bar 56 and prevent the chair from rocking.

It is noted that the longitudinal position of the legs 62 of the U-shape locking rod 58 can be adjusted with respect to the L-shape strips 66 to accurately position the bight 60 between the teeth of toothed bar in the ON position of the manual lever 76. This adjustment is normally effected at the chair manufacturing plant.

As soon as a person sits on the seat 6, the latter pivots downwardly about its front pivots 44 against the action of the tension springs 46 until the seat comes to rest on the rear cross brace 16 of the seat support frame 4; as shown in FIG. 2, this causes the bight 60 of the U-shape locking rod 58 to clear the toothed bar 56 allowing the seated person to rock the chair in conventional manner. As soon as the person wishes to leave the chair, she moves forwardly of the seat and starts to stand up using the arm rests 18 as a support; the seat 6 immediately pivots back to its upper limit position causing the locking device to lock the seat support frame 4 and seat against rocking. The person can then further use the now stationary arm rests to completely stand up.

This system has been found to be very convenient for persons having difficulty to stand up from a chair which is free to rock.

Figure 3:
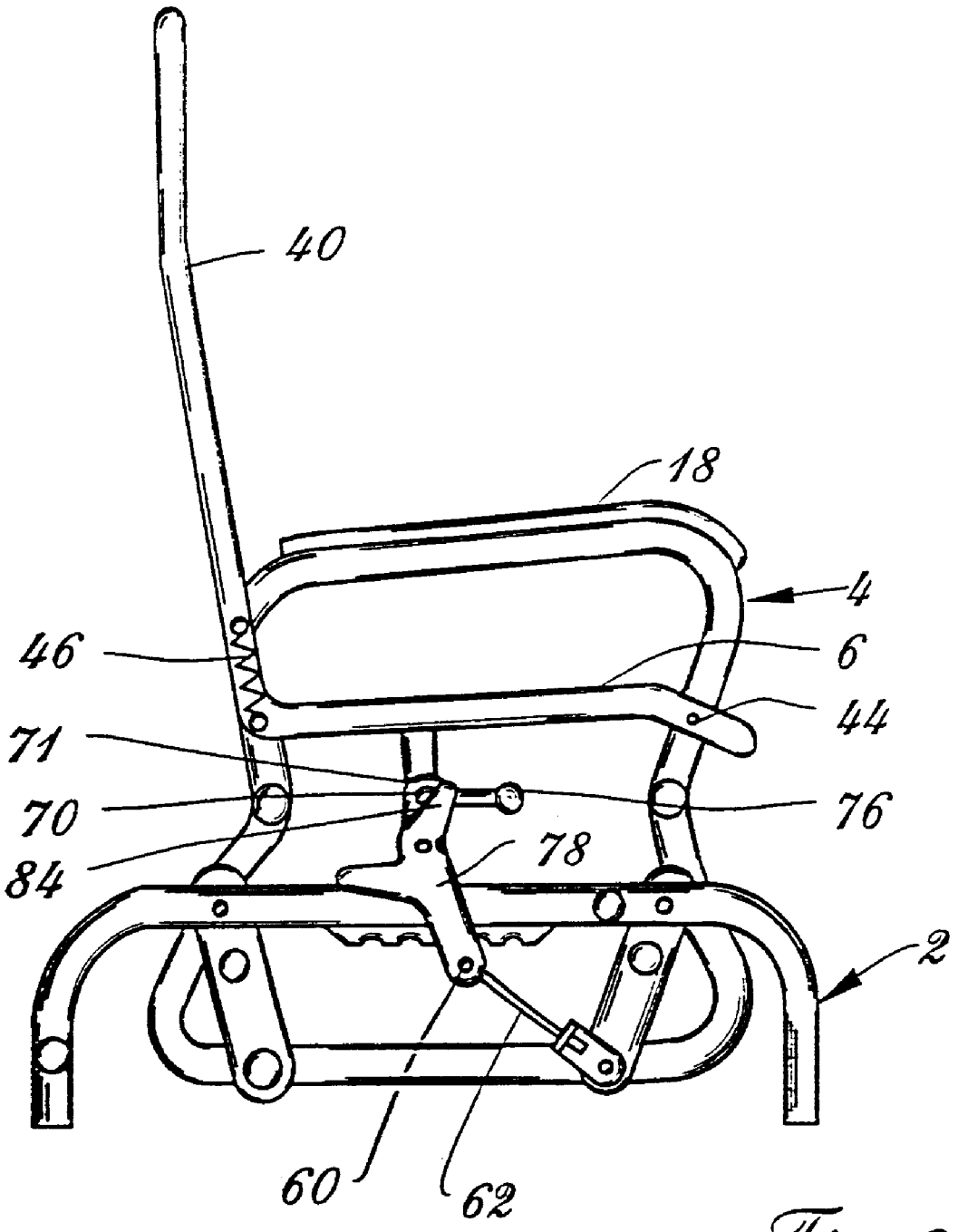
Figure 4:
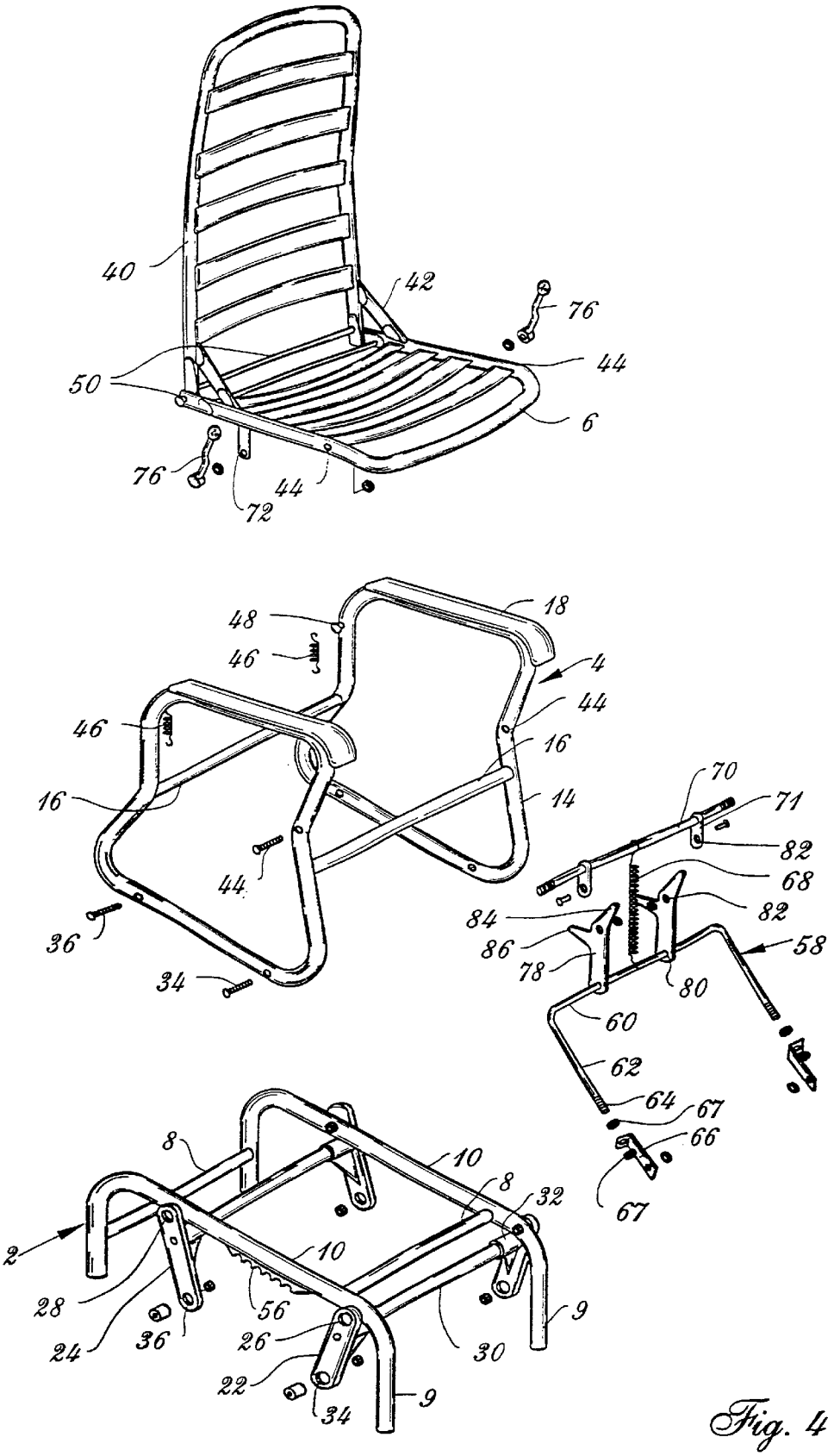
FIG. 4 is an exploded perspective view of the rocking chair of FIG. 1.

If so desired, the manual lever can be pivoted to the OFF position as shown in FIG. 3, wherein the locking device is non operational whether the seat is in down or up limit position since the link formed by toggle lever 71, 78 between seat 6 and locking rod 58 is longer than in the ON position of toggle lever 71, 78.

Reference will now be made to the second embodiment of the invention, shown in FIGS. 5 to 11. This embodiment shows the preferred way to carry out the invention.

Figure 6:
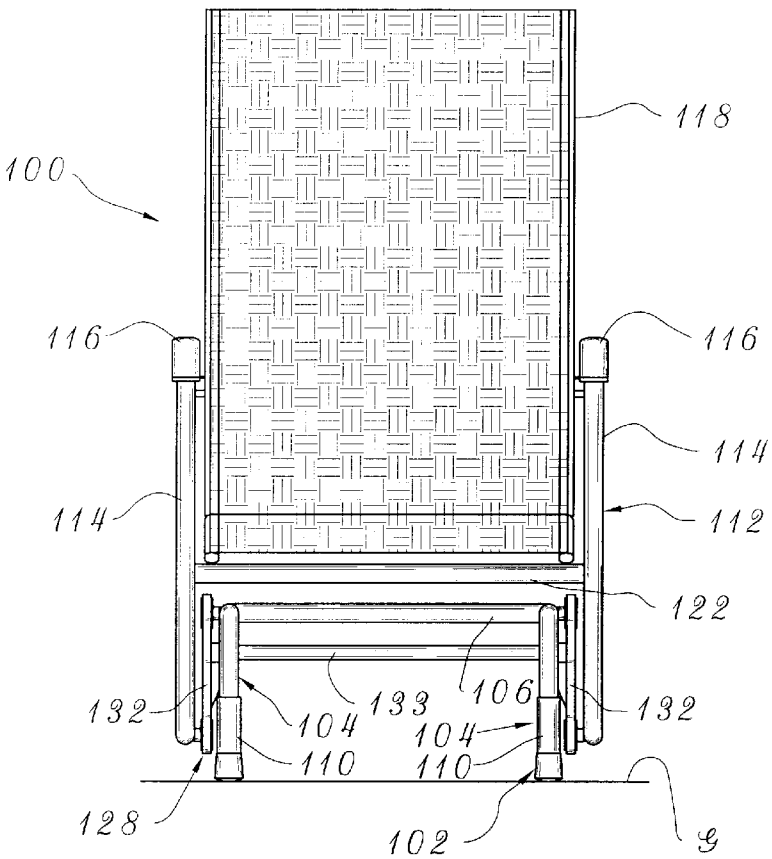
FIGS. 5 and 6 are respectively a side elevation and a rear elevation of the rocking chair of the invention according to a second, preferred embodiment.
Figure 5:
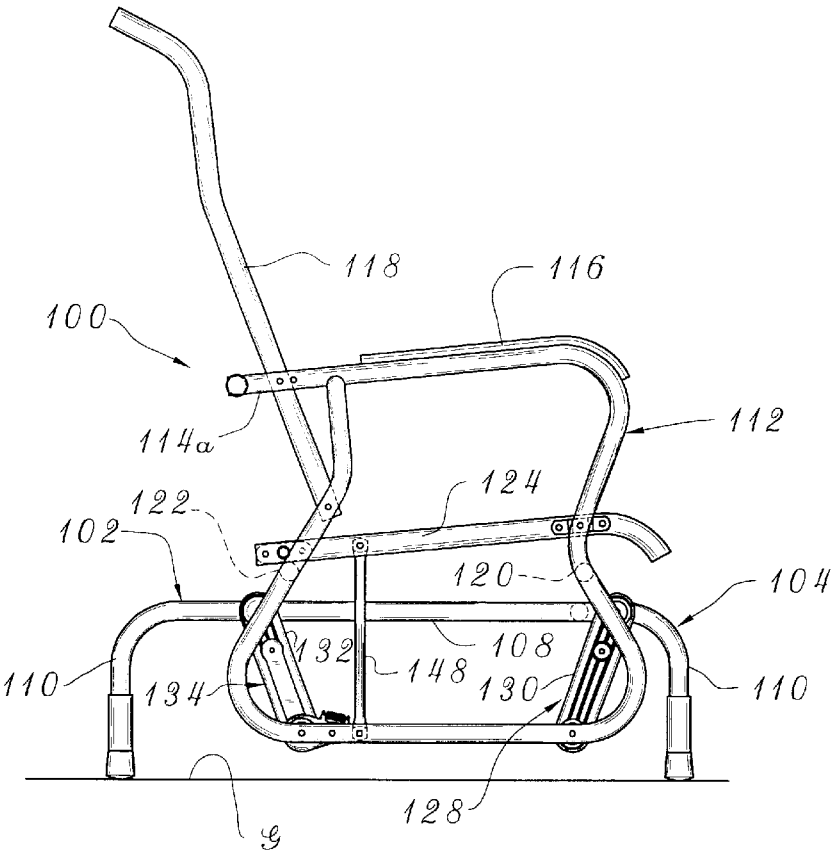

FIGS. 5 and 6 show a second embodiment of a rocking chair 100 according to the present invention, which comprises a ground-resting base 102 having a pair of spaced-apart, inverted U-shaped tubular members 104 joined by a pair of cross-braces 106 (with the front most cross-brace being concealed in FIG. 6 by the rearmost cross-brace 106). U-shaped members 104 each include a bight member 108 carried by a pair of end legs 110 resting on the ground G.

Base 102 rockably carries a seat support frame 112 formed of a pair of spaced-apart generally quadrandular tubular members 114, 114. The top of each tubular member 114, 114 carries an arm rest 116, 116. A backrest 118 is supported in an inclined position by quadrangular tubular members 114, 114 and by a tubular extension 114*a*, 114*a* thereof. A front cross brace 120 and a rear cross brace 122 rigidly link the two quadrangular tubular members 114, 114.

Figure 7:
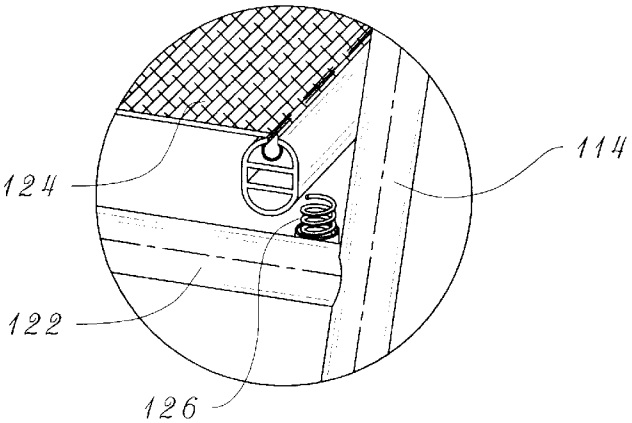
FIG. 7 is an enlarged perspective view of the rear comer portion of the seat of the rocking chair of FIGS. 5 and 6.
Figure 9:
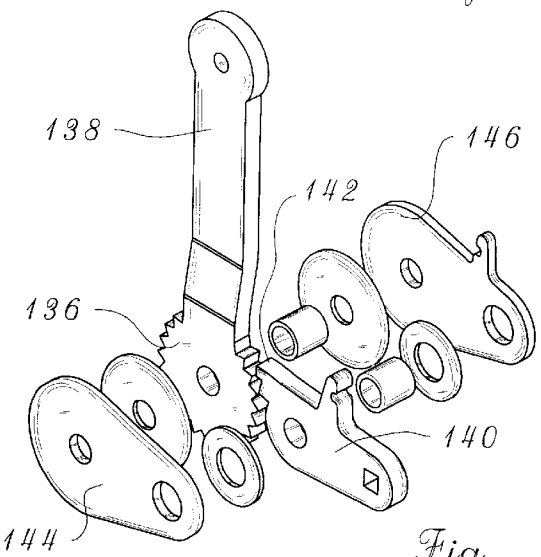
FIG. 9 is an enlarged exploded perspective view of the locking mechanism of the rocking chairs FIGS. 5 and 6.
Figure 8:
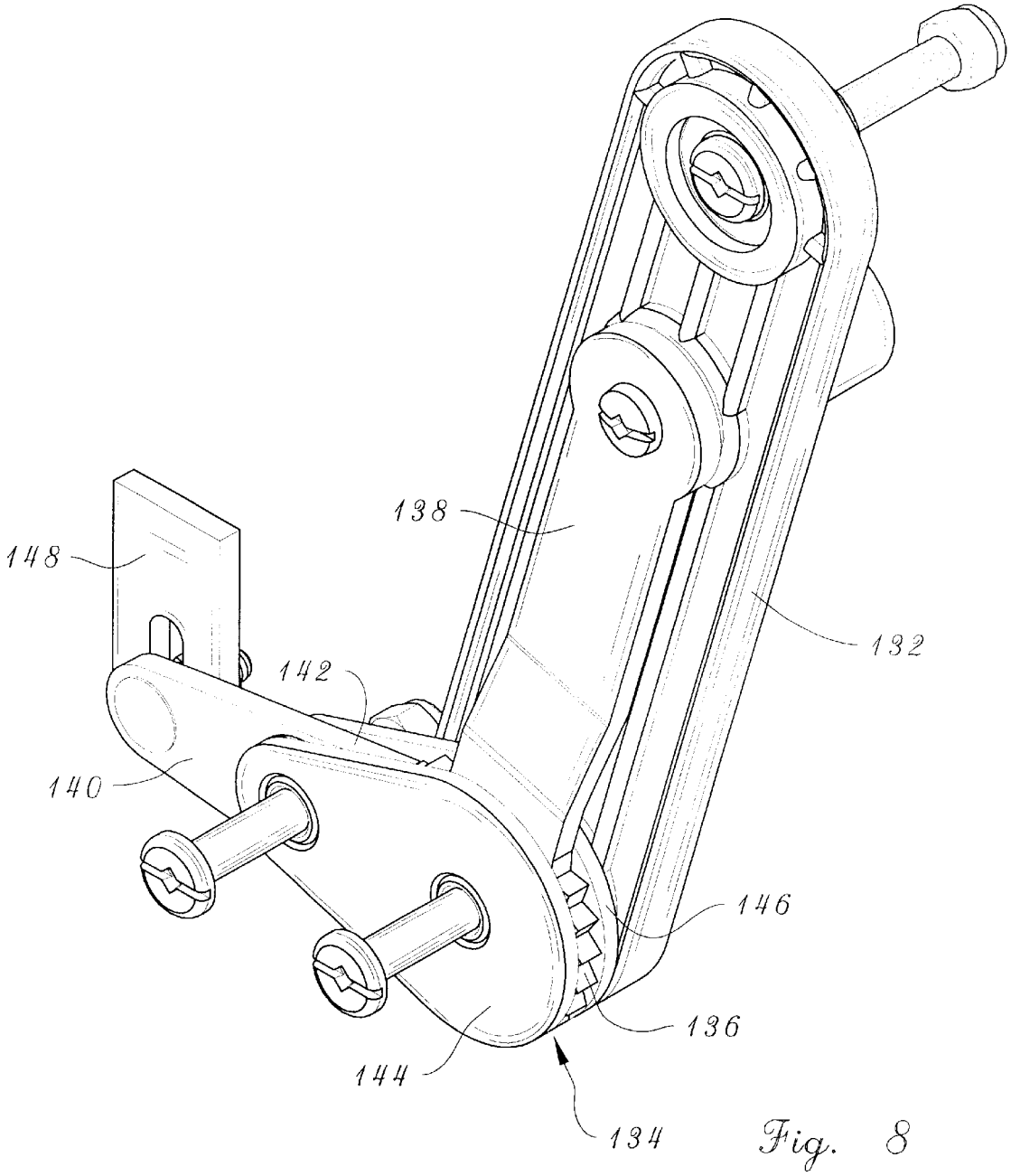
FIG. 8 is an enlarged perspective view of the locking mechanism of the rocking chair of FIGS. 5 and 6.

A seat 124 is pivotally carried at its front end portion by quandrangular tubular members 114, 114 spacedly over front cross brace 120, and its rear end portion is movable between an upper position, in which it is located spacedly over rear cross brace 122, and a lower limit position, in which it abuts and rests against rear cross brace 122 which then also acts as a stopper for the rear end portion of seat 124. As shown in FIG. 7, a biasing device in the form of a pair of compressed coil springs 126 (with only one spring being shown in FIG. 7) installed between rear cross brace 122 and seat 124 and fixed to rear cross brace 122, continuously biases seat 124 towards its upper position.

Rocking chair 100 is provided with a rocking mechanism 128 which includes a pair of front arms 130 (with one front arm being concealed in the drawings) and a pair of rear arms 132, 132 which are pivotally carried and depend at their upper extremities from the bight members 108 of base 102. The lower extremity of front and rear arms 130, 132 pivotally carry seat support frame 112; indeed, they are pivotally attached to the lower portion of the frame quadrangular tubular members 114, 114. Thus, as with the first embodiment of the invention, the seat support frame 112 and consequently the attached seat 124 and backrest 118, can rock about base 102. A cross brace 133 fixedly attached at its extremities to rear arms 132, 132, rigidly links same.

At least one and possibly two locking mechanisms 134 are further provided on rocking chair 100, with only one locking mechanism being shown in the drawings. Locking mechanism 134, as shown in FIGS. 5 to 11, includes a toothed ratchet wheel 136 integrally supported by a support plate 138 to a corresponding rear arm 132. Thus, ratchet wheel 136 integrally pivots with rear arm 132 about the chair base 102.

Locking mechanism 134 further comprises a toggle member 140 including a notched pawl 142 at a first free end portion thereof for removable complementary engagement into the teeth of toothed wheel 136. Toggle member 140 is pivotally carried at an intermediate portion thereof between a pair of side plates 144, 146 which are fixedly attached to quadrangular tubular member 114 and between which ratchet wheel 136 and rear arm 132 can pivot. A second end portion of toggle member 140, opposite pawl 142, is pivotally attached to the lower extremity of a link member 148. Link member 148 is pivotally attached at its upper extremity to the rear end portion of seat 124.

Figure 10:
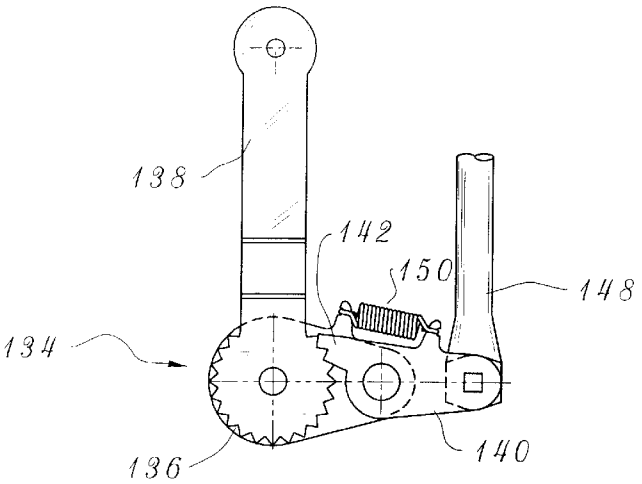
FIGS. 10 and 11 are side elevations of the locking mechanism of the rocking chair of FIGS. 5 and 6, respectively showing the locking mechanism in a locked and unlocked condition.
Figure 11:
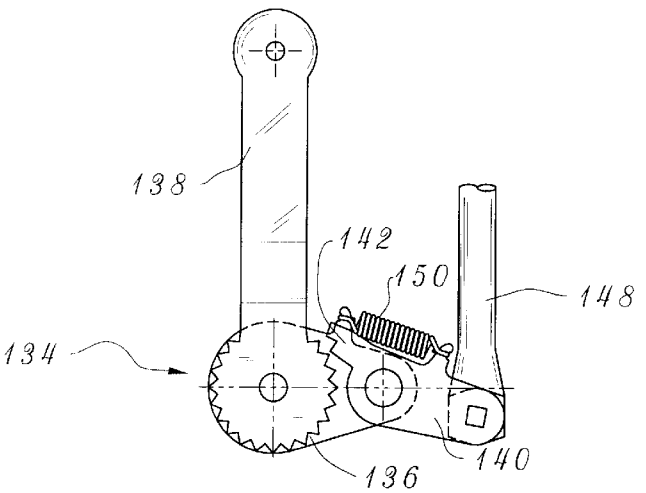

Thus, toggle member is pivotable between a first limit position, in which pawl 142 engages toothed wheel 136 (FIG. 10), and a second limit position in which pawl 142 spacedly clears toothed wheel 136 (FIG. 11). A biasing device in the form of a tensioned coil spring 150 (not shown in FIGS. 8 and 9—see instead FIGS. 10 and 11) is hooked up to hooking fingers 152, 154 respectively integrally provided on toggle member 140 and a side plate 146, to continuously bias toggle member 140 towards its first locked limit position.

As already stated, it is preferred to provide two locking mechanisms 134, i.e. one positioned adjacent to each rear arm 132, for enhanced rigidity.

In use, when a person sits on the rear end portion of seat 124, i.e. spacedly behind its front pivotal attachment to seat carrying frame 112, the person's weight will lower the rear end portion of seat 124 towards its lower limit position against the bias of springs 126, until seat 124 abuts and rests against rear cross brace or stopper 122. This will concurrently downwardly force link member 148 which will act on toggle member 140 to pivot same towards its second unlocked limit position shown in FIG. 11, against the bias of spring 150. In this second limit position of toggle member 140, pawl 142 clears ratchet wheel 136 and consequently seat support frame 112, seat 124 and backrest 118 are free to rock about the chair base 102.

When a person rises from the rear end portion of seat 124, compressed coil spring 126 will lift seat 124 and consequently link member 148 also, which will force toggle member 140, with the aid of tensioned coil spring 150, towards its first locked limit position shown in FIG. 10. In this first limit position of toggle member 140, pawl 142 operatively engages ratchet wheel 136, and thus prevents relative pivotal displacement between (a) the ratchet wheel support plate 138 and consequently the chair rear arm 132; and (b) link 148. This results in locking mechanism 134 preventing seat support frame 112, seat 124 and backrest 118 from rocking relative to base 102 ma rearward direction only, while still allowing frontward rocking motion thereof.

An important advantage of locking mechanism 134, compared to the locking mechanism of the first embodiment, is that a person may rock seat 124 (and frame 112 and backrest 118) frontwardly without the seat 124 being allowed to move rearwardly. This is accomplished by sitting on the front end portion of seat 124, i.e. approximately over and/or frontwardly of the pivotal attachment of seat 124 to frame 112, where seat 124 will remain in its upper limit position. In this position of seat 124, the engagement of pawl 142 against ratchet wheel 136 indeed allows the rocking mechanism to move in a single direction, i.e. seat 124 may move frontwardly. Indeed, pawl 142 will sequentially engage one tooth after another in ratchet wheel 136 during gradual forward movement of seat 124, preventing rearward movement of seat 124.

This is an important advantage, which benefits physically impaired persons which may otherwise have a hard time rising from a rocking chair. Indeed, with the rocking chair 100 of the second embodiment, it is possible to move seat 124 to a frontmost limit position relative to base 102, while still fully rearwardly resting against seat 124 and armrests 116 without seat 124 or armrests 116 moving rearwardly. The person may then rise more easily from such a frontward position of seat 124, or alternately the person may use armrests 116 as a support to transfer from rocking chair 100 to an adjacent wheel chair. In any event, the wide base 102 provides a reliable stability to chair 100, while the frontward rocking motion of seat 124 is allowed without any rearward rocking motion thereof, consequently providing an easier position for rising from seat 124, especially for a physically impaired person.

This is especially true considering the fact that physically impaired persons are often unable to rise from a chair, rocking or conventional, directly from an initial position in which they are seated at the rear end portion of seat 124. Indeed, the physically impaired persons will rise from the chair in a two-step process, firstly sliding toward the front edge of the seat and secondly rising from the seat, all along helping themselves with the armrests. With the rocking chair 100 of the second embodiment of the invention, the second rising step is facilitated, since during the first step, the seat 124 will automatically move forward under the person sliding towards the frontward edge of seat 124 while pushing against armrests 116.

This is different from the chair of the first embodiment, in which the seat will become locked as soon as the person lifts his or her weight from the rear end portion of the seat, thus preventing the helpful frontward motion of the seat.

Another advantage of the rocking chair 100 according to this second embodiment, is that the locking device is silent relative to the locking device shown in the first embodiment, in which the locking rod 58 would noisily engage the toothed bar 56.

Any modifications to the present invention, which do not deviate from the scope thereof, are considered to be included therein.

It is envisioned that the ratchet locking device including a ratchet wheel and a pawl member be replaced by any other suitable ratchet joint member provided on the two parts of the locking device, namely the first part attached to the seat support frame and the second part attached to the rocking device. Also, the second part installed on the rocking device could be installed on the base member. For example, such other ratchet joint member could be a toothed rack provided on the bight member 108 of the base member 102, with a pawl member attached to the seat support frame and being set into either one of an inoperative condition, in which it clears the rack, and an operative condition, in which it engages the rack, depending on whether a person is sitting on the chair seat or not, respectively.

More generally, any suitable unidirectional locking device could be provided, wherein the seat support frame (and consequently the seat mounted to the seat support frame) is allowed to rock in a first direction, but prevented to rock into a second direction opposite the first direction, when the unidirectional locking device is set into its operative condition. In the inoperative condition of the unidirectional locking device, the seat support frame is allowed to rock in both the first and second directions. For example, hydraulic rams could be used as an unidirectional locking device to control the rocking of the seat support frame, with a fluid circuit that prevents the ram piston from being retracted if nobody is sitting on the rear seat portion for consequently preventing rearward rocking motion of the seat support frame in such a condition. Any other hydraulic, mechanical, electrical or otherwise suitable unidirectional locking device could be acceptable.

The link member shown in the drawings as a rigid rod 148, could also be any other type of suitable link member changing the condition of the unidirectional locking device from its operative to its inoperative condition responsively to a load being applied on the chair seat. For example, a switch linked to an electric circuit could be provided under the seat for transmitting a signal to a powered unidirectional locking device when a person sits on the chair seat, to disactivate the unidirectional locking device. Thus, any suitable mechanical, electrical or otherwise suitable link member would be acceptable.

What is claimed is:

1. A rocking chair comprising a ground-resting base member, a seat support frame, a rocking device rockably mounting said seat support frame to said base member, a seat defining a front end portion and a rear end portion and pivotally mounted on said support frame at said front end portion allowing limited up and down movement of said seat rear end portion between an upper position and a lower limit position, a stop carried by said seat support frame and engaging said seat rear end portion in its lower limit position, a biasing device continuously biasing said seat towards said upper position, where upon the weight of a person seated on said seat rear end portion lowering said seat rear end portion to its lower limit position against the bias of said biasing device, and a unidirectional two part ratchet locking device having a first and a second part respectively carried by a corresponding one of:

a) a selected one of said base and said rocking device; and b) said seat support frame; said first and second parts of said unidirectional two part ratchet locking device being mutually engageable when said seat is in said upper position and clearing each other when said seat is in said lower limit position, wherein said seat and said seat support frame are automatically locked against rocking motion in the direction of said seat rear end portion while being allowed to rock in the direction of said seat front end portion when said first and second parts of said unidirectional two part ratchet locking device are mutually engaged, and wherein said seat and said seat support frame are allowed to rock in both the directions of said seat front and rear end portions when said first and second parts of said unidirectional two part ratchet locking device clear each other.

2. A rocking chair as defined in claim 1, wherein said seat support frame forms arm rests disposed above said seat.

3. A rocking chair as defined in claim 2, further including a back rest attached to said seat support frame in an upstanding position relative to said seat.

4. A rocking chair as defined in claim 1, wherein said rocking device includes front and rear rocking arms defining opposite upper and lower end portions, said rocking arms depending from said base member and being pivotally mounted thereon at said upper end portions thereof, and a lower portion of said seat support frame being pivotally connected to said lower end portions of said rocking arms.

5. A rocking chair as defined in claim 4, wherein said first part of said two part ratchet locking device is a ratchet wheel fixedly attached on the lower end portion of one of said rocking arms for concurrent pivotal displacement therewith, and said second part of said two part ratchet locking device is a pawl member pivotally attached to said seat support frame, said ratchet locking device further comprising a rigid link member pivotally attached to said seat rear end portion and to said pawl member, said link member pivoting said pawl member in a first locked condition, when said seat is in said upper position, in which said pawl member and said ratchet wheel are mutually engaged to prevent rocking of said seat and said seat support frame in the direction of said seat rear end portion, while allowing rocking motion of said seat and said seat support frame in the direction of said seat front end portion, and a second unlocked condition, when said seat in said lower limit position, in which said pawl member clears said ratchet wheel to allow rocking motion of said seal and said seat support frame in both the directions of said seat front and rear end portions.

6. A rocking chair as defined in claim 5, wherein said ratchet locking device further comprises a biasing device attached to said pawl member and to said seat support frame, said biasing device continuously biasing said pawl member towards said locked condition.

7. A rocking chair as defined in claim 6, wherein said biasing device is a spring.

8. A rocking chair as defined in claim 5, further comprising a second locking device identical to the first-named locking device, wherein the ratchet wheels of said first-named and said second locking devices are fixedly attached to respective rocking arms.

9. A rocking chair comprising a ground-resting base member, a seat support frame, a rocking device rockably mounting said seat support frame to said base member, a seat defining a front end portion and a rear end portion and pivotally mounted on said support frame at said front end portion allowing limited up and down movement of said seat rear end portion between an upper position and a lower limit position, a stop carried by said seat support frame and engaging said seat rear end portion in its lower limit position, a biasing device continuously biasing said seat towards said upper position, where upon the weight of a person seated on said seat rear end portion lowering said seat rear end portion to its lower limit position against the bias of said biasing device, and a unidirectional locking device including:

a first part and a second part each respectively mounted to a corresponding one of a) a selected one of said base member and said rocking device; and b) said seat support frame;

a ratchet joint member provided on said first and second parts, and a link member linking said seat rear end portion to said locking device second part for concurrent displacement of said second part between a locked position and an unlocked position responsively to corresponding displacement of said seat between said upper position and said lower limit position respectively, with said ratchet joint member being inoperative in said second part unlocked position and being operative in said second part locked position, wherein said seat and said seat support frame are automatically locked against rocking motion in the direction of said seat rear end portion while being allowed to rock in the direction of said seat front end portion when said ratchet joint member is operative, and wherein said seat and said seat support frame are allowed to rock in both the directions of said seat front and rear end portions when said ratchet joint member is inoperative.

10. A rocking chair as defined in claim 9, wherein said seat support frame forms arm rests disposed above said seat.

11. A rocking chair as defined in claim 10, further including a back rest attached to said seat support frame in an upstanding position relative to said seat.

12. A rocking chair as defined in claim 9, wherein said rocking device includes front and rear rocking arms defining opposite upper and lower end portions, said rocking arms depending from said base member and being pivotally mounted thereon at said upper end portions thereof, and a lower portion of said seat support frame being pivotally connected to said lower end portions of said rocking arms.

13. A rocking chair as defined in claim 12, wherein said first part of said locking device is a ratchet wheel fixedly attached at the lower end portion of one of said rocking arms for concurrent pivotal displacement therewith, and said second part of said locking device is a pawl member pivotally attached to said seat support frame.

14. A rocking chair as defined in claim 13, herein said locking device further comprises a biasing device attached to said pawl member and to said seat support frame, said biasing device continuously biasing said pawl member towards said locked position.

15. A rocking chair as defined in claim 14, wherein said biasing device is a spring.

16. A rocking chair as defined in claim 13, further comprising a second locking device identical to the first-named locking device, wherein the ratchet wheels of said first-named and said second locking devices are fixedly attached to respective rocking arms.

* * * * *